US012194390B2

(12) United States Patent
Garofalo

(10) Patent No.: US 12,194,390 B2
(45) Date of Patent: Jan. 14, 2025

(54) SYSTEM FOR IDENTIFYING AND TRACKING OBJECTS ON A GAME BOARD

(71) Applicant: XPLORED S.R.L., Genoa (IT)

(72) Inventor: Enrico Garofalo, Chiavari (IT)

(73) Assignee: XPLORED S.R.L., Rapallo (IT)

( * ) Notice: Subject to any disclaimer, the term of this patent is extended or adjusted under 35 U.S.C. 154(b) by 330 days.

(21) Appl. No.: 17/628,677

(22) PCT Filed: Jul. 27, 2020

(86) PCT No.: PCT/IT2020/050187

§ 371 (c)(1),
(2) Date: Jan. 20, 2022

(87) PCT Pub. No.: WO2021/019587

PCT Pub. Date: Feb. 4, 2021

(65) Prior Publication Data

US 2022/0258036 A1 Aug. 18, 2022

(30) Foreign Application Priority Data

Jul. 31, 2019 (IT) ..... 102019000013560

(51) Int. Cl.
*A63F 13/214* (2014.01)
*A63F 3/00* (2006.01)
*A63F 9/24* (2006.01)

(52) U.S. Cl.
CPC ..... *A63F 3/00643* (2013.01); *A63F 2003/00359* (2013.01); *A63F 2009/2439* (2013.01);

(Continued)

(58) Field of Classification Search
CPC .. A63F 3/00643; A63F 3/0052; A63F 13/214; A63F 2003/00381;

(Continued)

(56) References Cited

U.S. PATENT DOCUMENTS 9,849,369 B2 * 12/2017 Maharbiz ..... A63F 13/213
10,363,486 B2 * 7/2019 Rath ..... G06F 8/34

(Continued)

FOREIGN PATENT DOCUMENTS

EP 2884372 B1 2/2017
WO 2011107888 A1 11/2011

(Continued)

OTHER PUBLICATIONS

International Search Report for International Application No. PCT/IT2020/050187 mailed Feb. 4, 2021.

(Continued)

*Primary Examiner* — Omkar A Deodhar
(74) *Attorney, Agent, or Firm* — PERKINS COIE LLP; Colin Fowler; Willa Wu

(57) ABSTRACT

The finding and object of the invention relates to board games and parlour games characterized by the support of electronic components, such as a PC, tablet, smartphone or game console. More precisely, the invention consists of an economical and easy to construct system, able to identify and track the movements of objects, preferably but not necessarily pawns, on an interactive game board configurable by the user. Said playable and movable objects are tracked by means of a coordinated system of low-cost sensors and a method for the progressive storage of the positions assumed by the same objects as a result of voluntary user interactions. This result is achieved by means of: •A sensorized board (flexible or foldable) equipped with a series of magnetic sensors positioned according to a regular grid arrangement; •An electronic control board, connected to said sensorized board, adapted to the acquisition of data and the communication of the acquired information to a third system (PC, tablet, is smartphone, console) via interface (wired or radio); •An identification system, (Continued)

preferably but not exclusively of the RFID type consisting of reader chip and single antenna, integrated in the control board; •A series of modular tiles, of different shapes, which reproduce different environments, usable to create different game scenarios; •A series of profiled elements to keep the tiles integral with the interactive game board, once positioned above it; •A series of gaming elements, equipped with magnets and identification code (for example RFID TAG).

12 Claims, 6 Drawing Sheets

(52) U.S. Cl.
CPC ..... *A63F 2009/2486* (2013.01); *A63F 2009/2489* (2013.01)

(58) Field of Classification Search
CPC .. A63F 2003/00665; A63F 2003/00668; A63F 2003/00675; A63F 2009/2457; A63F 2009/2486; A63F 2009/2489
See application file for complete search history.

(56) References Cited

U.S. PATENT DOCUMENTS

| | | | | |
|---|---|---|---|---|
| 10,527,685 | B2 | 1/2020 | Garofalo | |
| 11,065,531 | B2 * | 7/2021 | Burrow | A63F 3/00895 |
| 11,123,632 | B2 | 9/2021 | Garofalo | |
| 2012/0052934 | A1 * | 3/2012 | Maharbiz | A63F 13/98 463/9 |
| 2014/0135124 | A1 * | 5/2014 | Jaqua | A63F 3/00214 273/287 |
| 2018/0207518 | A1 | 7/2018 | McClard et al. | |
| 2020/0222793 | A1 | 7/2020 | Garofalo | |
| 2022/0258036 | A1 * | 8/2022 | Garofalo | A63F 3/00643 |

FOREIGN PATENT DOCUMENTS

| | | | |
|---|---|---|---|
| WO | 2012033863 | A1 | 3/2012 |
| WO | 2015075713 | A1 | 5/2015 |
| WO | 2019035151 | A1 | 2/2019 |

OTHER PUBLICATIONS

Written Opinion for International Application No. PCT/IT2020/050187 mailed Feb. 4, 2021.

* cited by examiner

SYSTEM FOR IDENTIFYING AND TRACKING OBJECTS ON A GAME BOARD

CROSS-REFERENCE TO RELATED APPLICATIONS

This application is a § 371 national phase application of PCT/IT2020/050187 filed Jul. 27, 2020 entitled "SYSTEM FOR IDENTIFYING AND TRACKING OBJECTS ON A GAME BOARD," which claims the benefit of and priority to Italian Patent Application No. 102019000013560 filed Jul. 31, 2019, the contents of which being incorporated by reference in their entireties herein.

TECHNICAL FIELD

The finding and object of the invention relates to board games and parlour games characterized by the support of electronic components, such as a PC, a tablet, a smartphone or a game console. More precisely, the invention relates to a device and a method for tracking game objects which can be positioned and moved on a sensorized game board.

BACKGROUND ART

The finding and object of the invention relates to board games and parlour games characterized by the support of electronic components, such as a PC, a tablet, a smartphone or a game console. More precisely, the invention relates to a device and a method for tracking game objects which can be positioned and moved on a sensorized game board.

BACKGROUND ART

In the world of games, so-called hybrid games have emerged in recent years which, to increase the playing experience, provide for the connection and coordination between a physical game, i.e., characterized by concrete and manipulative objects, and a virtual game, i.e., coordinated software running on devices such as PCs, tablets, smartphones, game consoles or interactive gaming systems. Among these, so-called electronic board games and in particular those commercially known as the e-Pawn platform, Yoyn, have become increasingly important and widespread. Said games are characterized by complex constructive solutions for tracking playable elements, many of which have also been the object of a patent application. In general, these solutions provide for the integration into the game board of sensorized surfaces comprising a multitude of antennas or RFID readers (array of identical antennas with multiplexers used for their reading, overlapping antennas with multiplexers, antennas and multiple readers, etc.). These solutions allow the identification of each object positioned above each sensitive area which has an RFID tag, therefore, they further allow the tracking of the movements thereof from one area to another. Furthermore, more complex solutions are known, such as in patent applications WO2012033863 [Tweedletech LLC, Mar. 15, 2012], WO2011107888 [Angus Leigh et al, Sep. 9, 2012] where such RF antennas are further coupled with sensors of different nature, such as electrical switches, magnetic sensors, etc., or even, as in the Playtable platform, where the very surface of the interactive board consists of a screen equipped with touch detection functionality.

As an alternative to the radio-frequency (RF) approach, some solutions instead use tag arrays or sensor networks, positioned at key points, to track the movement of identifiable objects, but this approach also involves high costs and complexity and sometimes does not provide adequate performance in terms of accuracy, creating false positives, resulting in inaccurate measurements or generating excess and redundant data.

In order to simplify and, above all, reduce the costs related to the use of RF systems, solutions have been developed over time which employ magnetic sensor matrices to follow the path of a single object equipped with a magnet or to recognize patterns consisting of the resulting magnetic field, generated by a set of different magnets. From an operational point of view, these devices are made by positioning on the gaming area numerous magnetic sensors such as in WO2019/0351 A1 [Xplored Srl, 21 Feb. 2019], in such a way as to create a very dense grid, which increases the spatial sampling of the gaming area, but at the same time generates an "overlap" of sensitive areas from which arises the need to triangulate in order to obtain the position of a tracked object. Finally, some of these solutions (EP2884372, Commissariat l'énergie atomique et aux energies alternatives, 17 Jun. 2015), even allow to track the position and three-dimensional orientation of a magnet, but to do so require specific, very complex and expensive sensors, as well as control electronics equipped with a high computing power, to manage and process all the information.

The limitations of the first type of products described above, i.e., the systems equipped with multiple RFID antennas, possibly combined with other sensors, consist of the complexity of production and management of multiple RF devices and the related costs, which limit their diffusion in commercial applications. To date, many of the products which have adopted this technology have not yet been placed on the market or have not found diffusion, precisely because of the high costs and complexity of production on an industrial scale.

On the contrary, tracking systems based on the use of magnetic sensors alone are certainly much cheaper, but they do not allow the identification of objects and, in order to ensure continuous tracking, require a high "density" of sensors, i.e., a very dense grid, in which the sensitive areas of the different sensors partially overlap or are at least adjacent, in order to guarantee the continuity of the signal during the movements of the objects. A further limitation of the magnetic tracking systems is that they have strong limits in the tracking of multiple objects: in systems based on larger grids, formed by analogue sensors, since these can only measure the magnetic field strength at one point, it is not possible to distinguish whether this field is generated by a single magnet or by the combination of multiple magnets and/or whether it is produced by a small magnet near the sensor or by a larger magnet positioned at a greater distance. In the case of digital sensor grids and in the case of high sensitivity of the devices, on the other hand, the presence of a first magnet nearby, which activates the sensor, prevents the detection of the possible approach of a second magnet, resulting in problems of reading reliability and consistency.

Finally, all these solutions provide that the "coverage zones" of each sensor (radio, magnetic or other) are defined a priori (depending on the shape of the antennas, the sensitivity area of the magnets, etc.) and are therefore not adapted to detect the presence of objects in areas of irregular shape, not allowing the subdivision of the interactive surface into different areas, definable and configurable from time to time and depending on the needs and developments of the game. In the case of use of this type of device in board games, in particular in those where the interactive elements can be positioned by users in different and irregularly shaped areas which reconstruct, through interchangeable and modular tiles, gaming scenarios and environments, these functional limits of the known techniques are particularly evident and do not allow the correct tracking of the position of the pawns and the filtering of any involuntary movements, since all these systems are created with the aim of "tracking" the movement of the objects and acquiring an electronic trace, not allowing the detection only and exclusively of voluntary movements or those movements of objects resulting from the intentional choices of users.

DISCLOSURE OF THE INVENTION

The solution object of the patent aims to solve the aforementioned problems by means of an economical and easy to construct system, able to identify and track the movements of objects, preferably but not necessarily pawns, on an interactive game board, expandable and configurable by the user. The fact of using the same grid of fixed sensors to discern the movements of objects on gaming areas and variable paths (i.e., dynamically configurable by the user and not predetermined and known a priori) involves considerable problems. Since the overall gaming area is unknown a priori, the shape and size of the standstill areas in which the pawns pass during their journey are also unknown. These areas (which characterize each board game, obviously varying from one game to another) may, therefore, enclose one or more sensors which could be simultaneously excited by the presence of a pawn placed inside the area; in other cases the tracked pawn could end, in the movement thereof, near an edge between said standstill areas, thus generating the involuntary activation of additional sensors placed in the neighbouring area and thus preventing the certain recognition of the real standstill area. Again, in the course of the game, additional false positives could possibly be generated due to small involuntary movements of a pawn (for example vibrations, small interferences, shocks or errors) which, by exciting several contiguous magnets, will produce incorrect or in any case redundant tracking information which is not attributable to the conduct envisaged by the game.

The solution object of the patent intends to identify the objects to be tracked and follow the movements thereof, storing the series of successive positions which they assume as a result of voluntary interactions of users, in particular it intends to track the movements of said objects or pieces on an interactive and dynamically configurable gaming table, said interactive gaming table being obtained by placing tiles of different shape and size, on a sensorized board consisting of a fixed grid of low-cost magnetic sensors.

Therefore, to solve the problem of tracking objects on a gaming surface which can be dynamically varied and configured by the user, a coordinated system is proposed comprising:

- a board equipped with low-cost magnetic sensors arranged according to a regular and fixed grid;
- a series of modular tiles overlapping said board; said tiles characterized by various shapes and sizes and bearing on the surface signs and lines (segments, curves, dashes, symbols, etc., with different shapes and orientations) which allow to delimit areas of the gaming table and the functionality thereof; said tiles allowing to realize, by positioning and flanking on the sensorized board, a progressive and dynamically configurable gaming surface;
- a system for aligning the tiles with the underlying board and, in particular, for centring the tiles with respect to the grid of underlying magnetic sensors, said system allowing the reading radius of said magnets to be centred with respect to particular points of the tiles themselves;
- a method for the progressive storage of the positions assumed by the objects or pieces or playable elements located on the gaming table, as a result of voluntary user interactions, and able to interpret the commands differently according to the context and the gaming situation, based on the selective acquisition of data from the magnets and particularly on the acquisition of the status of only the grid sensors which are useful for tracking the gaming surface configured dynamically through the progressive positioning of the tiles positioned above the sensorized board.

BRIEF DESCRIPTION OF DRAWINGS

Further characteristics and advantages of the proposed technical solution will appear more evident in the following description of a preferred but not exclusive embodiment shown by way of non-limiting example in the accompanying 6 drawings, in which.

BEST MODE FOR CARRYING OUT THE INVENTION

According to an embodiment shown by way of non-limiting example, the invention can be realized through:

- A game board or table consisting of a flexible or folding board, equipped with a series of magnetic sensors, positioned according to a regular grid arrangement;
- An electronic control board, integrated or connected to said game board and used for the acquisition of magnetic sensor data and for the transmission of said information to a remote electronic device such as a PC, a tablet, a smartphone, a console; said transmission being possible by means of an interface and a wired or radio frequency connection;
- An identification system, by way of non-limiting example of the RFID type consisting of a reader chip and single antenna, integrated in the aforementioned control board;
- A series of modular tiles, positioned on the game board and characterized by variable shapes and sizes according to criteria defined subsequently; said tiles containing lines, signs and symbols useful for the progressive creation of a gaming table on which to move pieces and playable elements, said modular tiles being, therefore, used to dynamically create different gaming environments and scenarios;

A series of profiled elements to keep the tiles integral with the interactive game board, once positioned above it, and aligned with the underlying magnetic sensor grid;

A series of gaming elements, each equipped with a magnet and possibly characterized by a unique identification code such as an RFID TAG.

Figure 1:
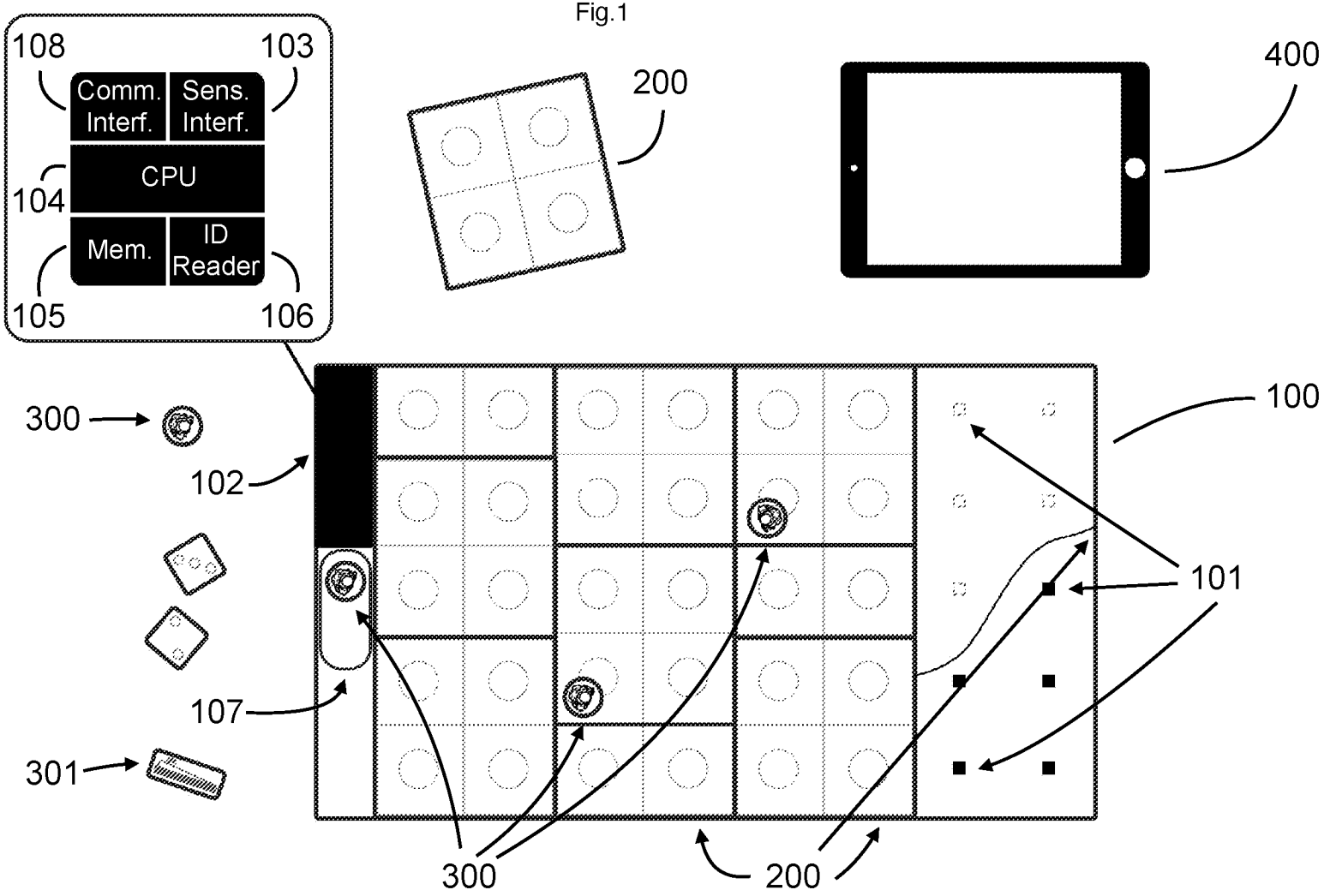
FIG. 1 represents the overall system, with evidence of the main components such as tiles, board with magnetic sensors, pawns and connected electronic device.

With reference to the accompanying drawings and in particular to FIG. 1, the main element of the system is represented, namely a sensorized table or board (100), inside which are pre-installed, according to a regular grid with fixed and predetermined pitch, magnetic sensors (101) which, by way of non-limiting example, may be of a digital type (e.g. Hall Switch). Such sensors are typically characterized by a reduced sensitivity by which they can detect the presence of magnets only within a relatively limited radius. The board (100) is also equipped with a control unit (102), which comprises: an interface for reading the status of the sensors (103), a CPU (104) for data collection and processing, a memory (105) for data management and programming the card itself, an identification apparatus (106), such as, but not limited to, an RFID reader equipped with a single antenna (107) for reading RFID TAGS, and at least one wireless or wired interface (108) for communication with remote electronic devices (400) such as tablets, smartphones, consoles, PCs, etc. Modular tiles (200) can be positioned on said board (100) and on said tiles gaming pawns or elements (300) and/or game scenario elements (301) to be tracked can be positioned and possibly moved.

Figure 2:
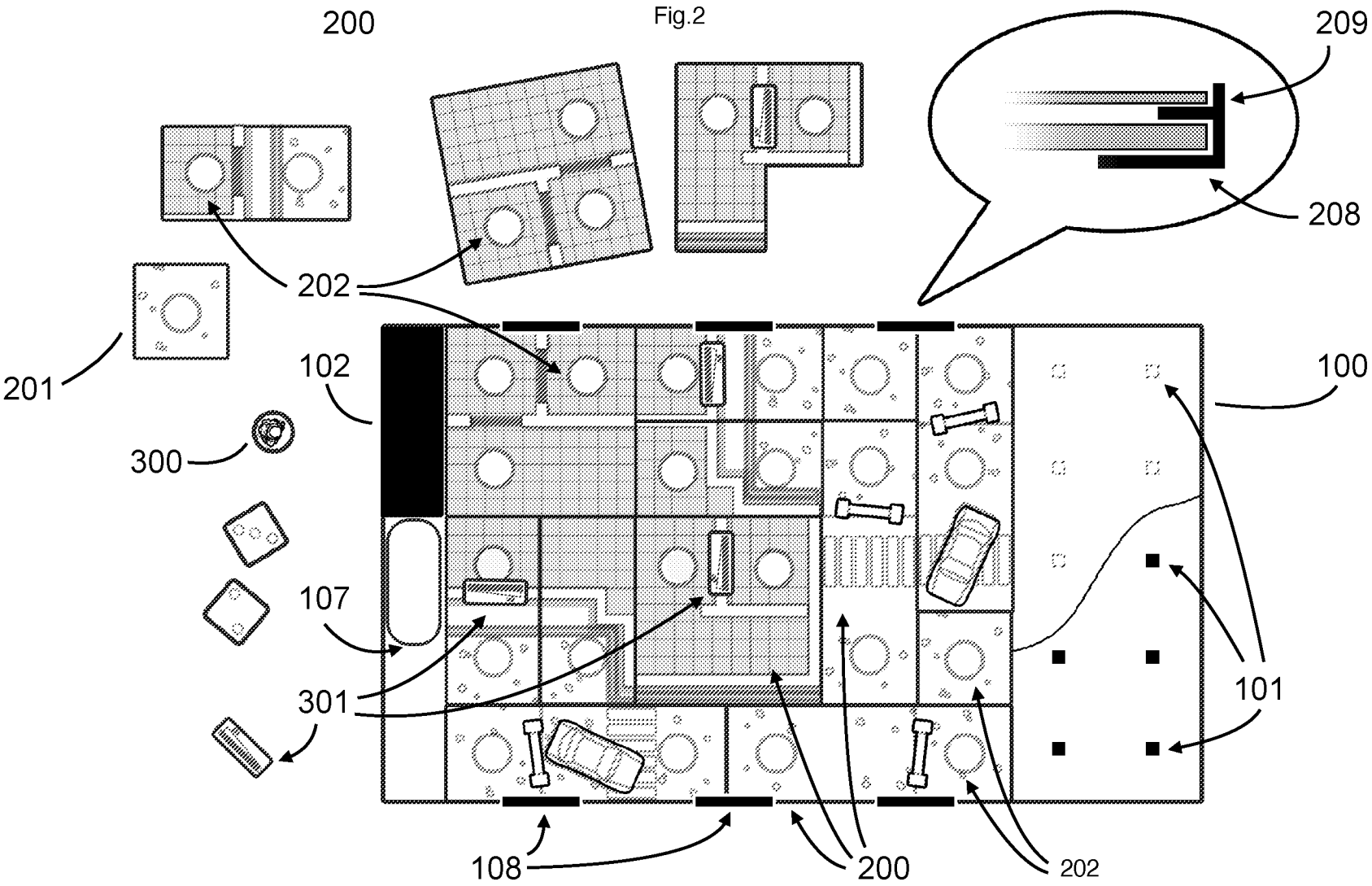
FIG. 2 represents in detail the positioning and alignment of the tiles on the sensorized board and the consequent dynamic and progressive creation of a possible gaming table.

With reference to the accompanying drawings and particularly to FIG. 2, the positioning of the modular tiles (200) on the board (100) is represented to form a gaming table. Said modular tiles (200) are heterogeneous and interchangeable and their mosaic composition allows to form, progressively, a gaming table dynamically configurable and customizable by the players, depending on the board game used. On said dynamically configurable gaming table, gaming pawns or elements (300) and/or other scenario elements (310) to be tracked will be positioned and moved.

The modular tiles (200), although having different shapes and sizes, are actually formed from the same base surface element (201); in particular they can be formed, for example, from squares having a side equal to the pitch of the magnetic sensor grid (101), i.e., the fixed distance which passes between two adjacent rows or columns of magnetic sensors (101) of the board (100). Following this constructive precaution, each modular tile (200) is characterized by a variable surface, provided that it is a multiple of the area of the base surface element (201), and by a variable shape, provided that it is obtained by flanking and combining said base surface elements (201) joined together on one or more sides. This constructive feature allows the modular tiles (200), once correctly positioned on the board (100), to align perfectly with the magnetic sensor grid (101). In this way the modular tiles (200), despite having different shapes and sizes, will regularly occupy the coverage area of the underlying magnetic sensors (101) and, in particular, the edges of said tiles will be positioned exactly in the centre of the space between contiguous rows and columns of the grid formed by said magnetic sensors (101), thus avoiding interference, overlapping, covering.

Furthermore, the modular tiles (200) are held in place by some lateral containment edges or elements (208), which engage the underlying board (100) and create a raised edge (209) which prevents the tiles from moving, thereby ensuring alignment between the graphic interaction points (202), reproduced on the tiles, and the magnetic sensors (101), integrated into the underlying board.

Figure 3:
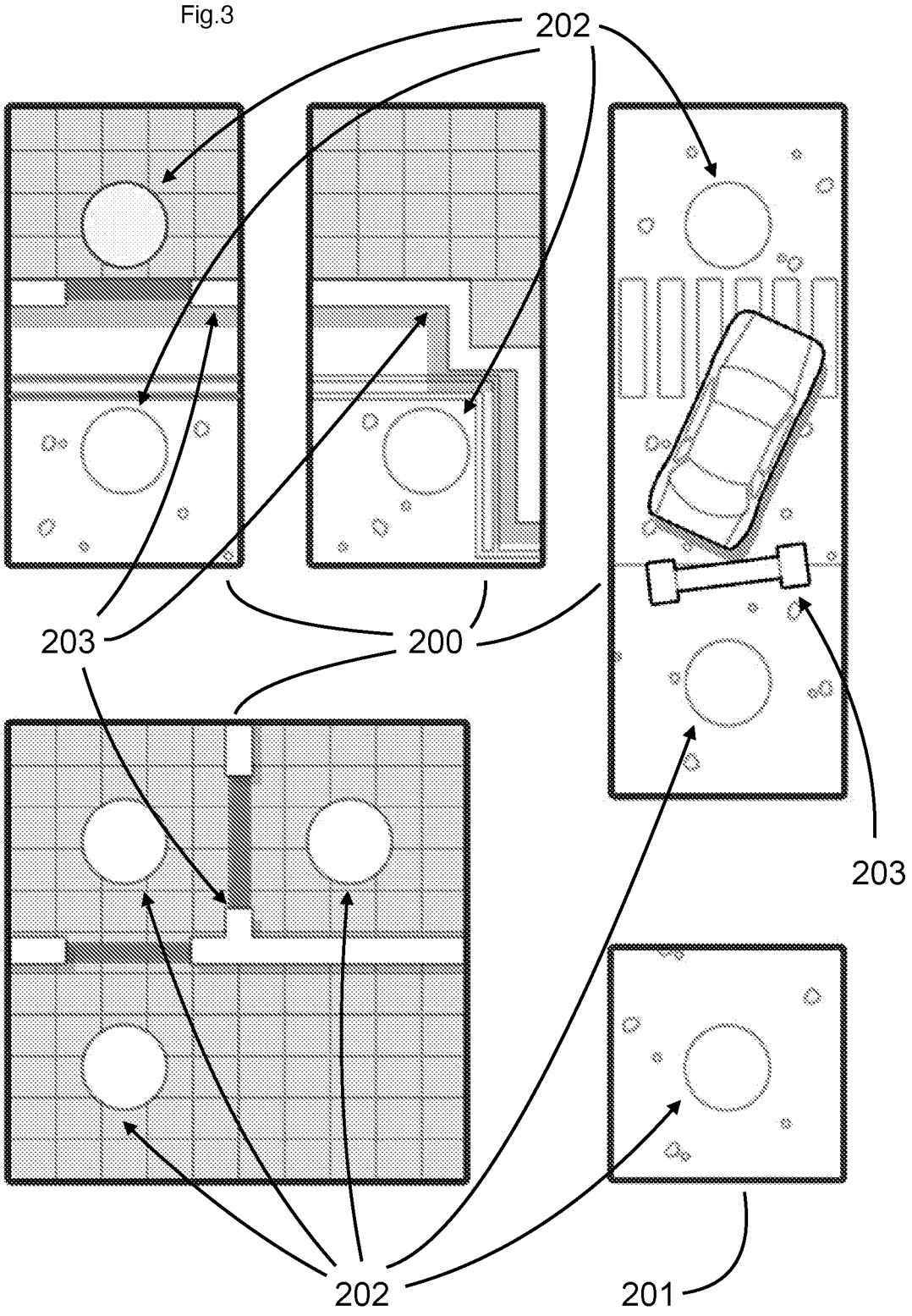
FIG. 3 represents some practical examples of tiles of various types and formats with evidence of some examples of lines of definition and delimitation of the gaming table.

With reference to the accompanying figures and particularly to FIG. 3, a plurality of modular tiles (200) of varying shape, size and surface graphics are represented. On the upper surface of the modular tiles (200), precisely at the centre of each of the base surface areas or elements (201), an easily identifiable graphic element (202) can be inserted from a visual point of view. Said element (202), in the specific embodiment represented, consists of a circle, but can evidently be replaced by functionally equivalent symbols such as, for example, a cross, a viewfinder, etc. Said graphic element (202) represents a so-called "point of interaction" and, in particular, said graphic element (202) will be positioned precisely at a single magnetic sensor integrated in the underlying board, which, among all the adjacent ones, will be the only one considered by the system for tracking purposes in the surface portion which the specific graphic interaction element (202) identifies in the modular tile (200). Each modular tile (200) of dimensions equal to two or more base surface elements (201), may therefore have one or more graphic interaction elements (202). In the presence of multiple graphic elements on the same modular tile (200), said elements may be separated by lines (203) of different shape such as curves, dashes, etc., which thus allow to create different and variable boundaries which separate surface portions of the same modular tile (200). Ultimately, the modular tiles (200) can, therefore, have variable dimensions and shape, as long as they are a multiple of a base surface element (201), have lines and separating sections, also irregular, on the surface (203) and integrate a plurality of said graphic interaction elements (202), which act as points of interaction and are uniquely associated with the portion of surface or space delimited by the outer edges of the tiles and possibly by the aforementioned lines (203). Dynamically, the modular tiles (200) may be positioned freely on the interactive board (100), depending on the rules of the associated board game, or according to the guide and support of the remote terminal (500). In this way, the modular tiles (200) can integrate with each other in various ways and form articulated surfaces capable of reproducing complex gaming scenarios and various kinds of environments. These environments are visually divided into different areas according to an overall graphic comprising all the separating lines (203) and additional decorative graphic elements, appropriately reproduced on the modular tiles (200). Said graphics, depending on the gaming table provided for the game, will comprise, for example, rooms, roads, premises of a ship, interiors of an aircraft, natural caves, etc., and can be arranged on the board (100) according to a progressive distribution; thanks to the lines (203) and/or the margins of said tiles, through the placement of the same tiles, gaming areas are formed and delimited in which there is always at least one graphic interaction element (202). Said graphic interaction element (202), thanks to the aforementioned modularity and constructive geometry of the modular tiles (200) and the containment elements (208), will be positioned exactly at one of the magnetic sensors (101) integrated in the board (100).

Figure 4:
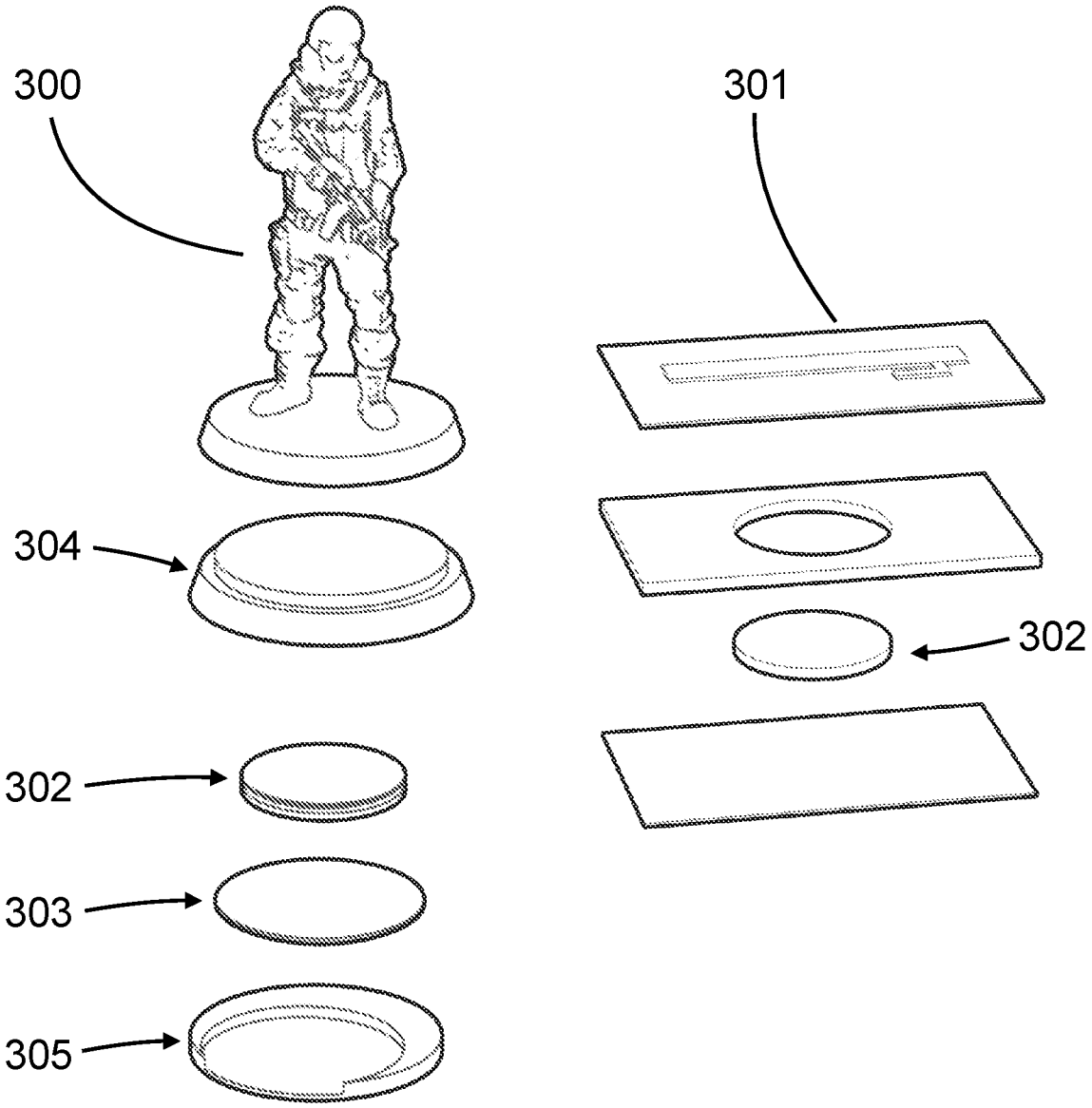
FIG. 4 represents the structure of the two types of trackable gaming elements.

With reference to the accompanying drawings and in particular to FIG. 4, two examples of playable elements are represented, i.e., identifiable and trackable objects, employed by the player in the gaming scenario obtained by progressively placing the modular tiles (200) on the sensorized board (100). These playable elements include two different types of objects: scenario elements (301), removable and representing peculiarities of the reproduced board game, such as, for example, doors, crates, vehicles, etc., or gaming elements (300), useful to depict the characters employed by the users. The scenario elements (301) are internally equipped with at least one magnet (302). The gaming elements (300) are equipped with a magnet (302) and a unique identification code (303) such as, for example, an RFID TAG or optical code, said elements being housed in a base (304) closed by a cover (305), integral with the gaming element (300) itself.

Figure 5:
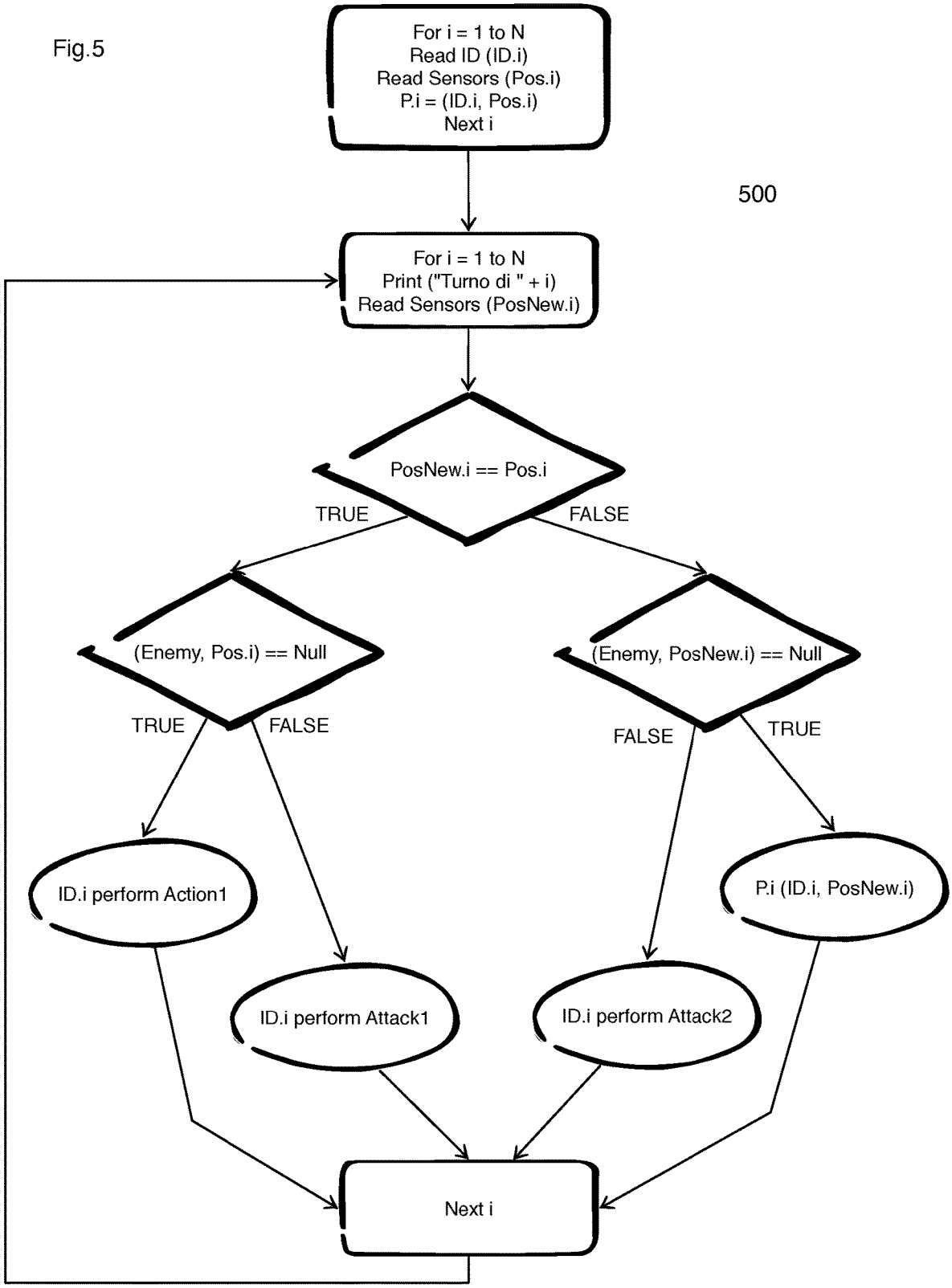
FIG. 5 is an algorithm which allows the system to understand the actions which the user intends to make, and to track the movements of the pawns accordingly.

With reference to the accompanying drawings, and particularly to FIG. 5 of the same, is represented, in the form of an algorithm (500), a method which matches each gaming pawn or element (300) with the area hosting it, that is, with the portion of space of the modular tile (200) delimited by demarcation lines (203) in which it is located, and which allows identifying the voluntary action which the user intends to perform, simply by tracking the status of the sensors with which the user decides to interact. According to said algorithm, the gaming pawns or elements (300) are recognized through their own unique identification code (303) in the initial phase of the game. The recognition occurs through the identification apparatus (106), for example, through the RFID reader and the antenna (107) thereof. Subsequently, by establishing the order of movement of the pawns, it is no longer necessary for them to be identified each time they are moved on the board and the movements of the gaming pawns or elements (300) can be tracked through the memory of the positions subsequently occupied as a result of the movements between one area and another of the overall gaming surface, formed by the modular tiles (200) positioned on the sensorized board (100). Said algorithm (500) may also automatically recognize the will of the user to perform certain actions, as an alternative to the simple movement of his/her own pawn, based on play situations; by way of non-limiting example, if the user voluntarily interacts with the sensor located in the same area in which his/her pawn is already located, the system may recognize the will to perform an action in said area, for example the construction of a shelter, the search for an object or other. Similarly, if there is an opponent in the area where the user declares to want to interact, by placing the pawn on the relative point of interaction, the system may automatically recognize the user's will to carry out an attack against said opponent, and so on.

Figure 6:
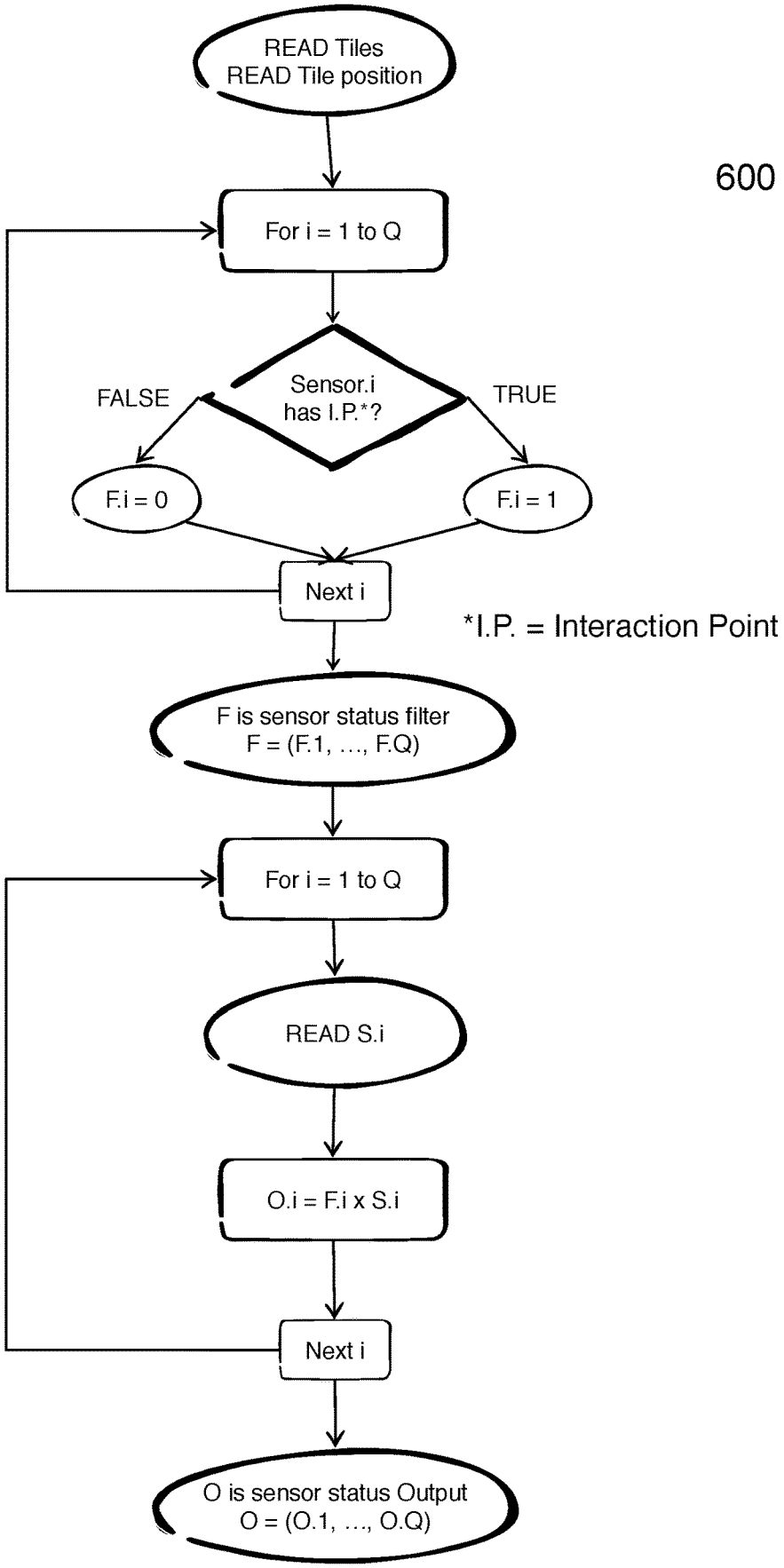
FIG. 6 represents the algorithm which, as possible gaming scenarios change, allows to select, within the grid of sensors of the board, a subset of magnetic sensors useful for the effective tracking of movements and actions of the pawns.

With reference to the accompanying drawings, and particularly to FIG. 6 of the same is represented, in the form of an algorithm (600), the method which defines how, by varying the possible gaming scenarios obtained by positioning the modular tiles (200) on the sensorized board (100), the system can select a subset of significant magnetic sensors (101) and, therefore, to take into account for the tracking of the objects. According to said algorithm, once the position and orientation of the different modular tiles (200) is known, the system elaborates, depending on the overall scenario determined by the lines (203) and modular tiles (200) used in that specific embodiment, a mask vector [F.1, F.2, . . . , F.Q]; said vector to be used for the selection of magnetic sensors useful for tracking that game context, among all the Q sensors present on the game board.

The mask vector is characterized by "Q" components, where Q corresponds to the number of magnetic sensors (101) employed in the grid of the sensorized board (100). The values of said mask vector components will be "0" or "1" depending on whether the n-th magnet information is respectively to be discarded or taken into account for the purpose of the gaming element tracking procedure (300), (301). At each play turn, the system scans the entire grid of the Q magnetic sensors (101) and obtains a vector of the excitation state of all the magnetic sensors [S.1, S.2, . . . , S.Q]. Said magnetic sensor status vector is multiplied by the aforementioned mask vector (multiplication intended for corresponding components), returning a masked result vector O, which resets the unnecessary magnet information and retains only the magnetic sensor information useful for tracking objects on the assembled gaming table and, therefore, intended to be transmitted to the remote electronic device (400).

With reference to all the previous figures, an example of functional use of the proposed solution is described below, by way of non-limiting explanation.

In the current use, a preparatory step is provided, during which the modular tiles (200) are positioned on the sensorized board (100) so as to construct the selected game scenario; said positioning may be guided by the remote electronic device (400), based on the game to be performed or be freely undertaken by the user. In either case, once the arrangement of the modular tiles (200) on the sensorized board (100) has been completed, the information relating to the final layout of the assembled gaming table such as mapping, type of tiles used, etc., must be transmitted to the remote electronic device (400) so that it can take this into account in the subsequent steps. The acquisition of such information may take place, for example but not limited to, by means of camera acquisition or screen reconstruction with graphic tools which reproduce the individual tiles, etc. Alternatively, the modular tiles (200) may be provided with an identification code (optical TAG or ID or otherwise) and be automatically recognized by the system, leaving the user the sole task of indicating to the remote electronic device (400) the position and orientation in which the modular tile (200) has been positioned on the sensorized board (100).

Once the modular tiles (200) have been positioned, the lateral containment edges or elements (208) are arranged, useful to align the mosaic composed of the modular tiles (200) with the underlying sensorized board (100) and, more precisely, to ensure that the graphic interaction points (202) of the modular tiles (200) are perfectly aligned with the magnetic sensors (101) of the sensorized board (100). The control unit then proceeds, through the algorithm (600), to generate the mask vector which characterizes the scenario set up by placing said modular tiles (200) on the sensorized board (100), in order to limit the analysis of the status of the magnetic sensors (101) only to the significant sensors.

The scenario elements (301) must be positioned on the gaming table with magnets (302) located at the interaction points (202) of the modular tiles (200), such that the removal or displacement thereof may be detected by the control system. The presence of a scenario element (301) prevents, in fact, interaction with the area occupied by the same, keeping the underlying sensor constantly energized, unless said element is removed. In this circumstance, the system, noticing the sudden absence of a signal on the magnetic sensor hitherto occupied by the scenario element, identifies the interaction performed by the user and can associate it with gaming events corresponding to said action, such as the opening of a door, the removal of an obstacle, etc., according to the rules of the game implemented.

Once the modular tiles (200) and scenario elements (301) have been positioned, the gaming pawns (300) are positioned. Said gaming pawns or elements (300) are first arranged, to be recognized by the identification apparatus (106), for example near the antenna (107) in case of RFID recognition or, in any case, in an area of the board dedicated to recognition. Once identified, the pawns (300) are positioned on the magnetic sensor which identifies the first "area", where the object is located at the initial moment. The controller (102) thus stores the identifier and first location for each of the objects used.

According to an alternative implementation, the control unit or the remote electronic device (400) to which it is connected, could indicate the order in which to place the pawns on the gaming table, thus rendering their identification unnecessary and allowing to match each gaming element (300) with the initial position, without having to resort to a unique identification code for each of them.

Once this setting has been completed, the playable objects (300, 301) can then be moved voluntarily by users, from one area of the gaming table created by the positioning of the modular tiles (200), simply by taking them from the area in which they are located and positioning them at the graphic interaction point (202) of the new area in which the element is to be moved, thus activating the magnetic sensor (101) corresponding to the new position. At each movement, the CPU (104) identifies, through the algorithm (500), the action which the user intends to perform and, in the case of a movement, updates the position of each of the playable objects (300, 301) tracked, based on the sequence of magnetic sensors (101) deactivated/activated.

INDUSTRIAL APPLICABILITY

The invention can be realized with technical equivalents, with supplementary materials or solutions suitable for the purpose and the application scope. Conformation and dimensions of the constituent parts may vary in a suitable, but consistent way with the proposed solution.

By way of non-limiting example, it is noted that the geometric shapes of the involved parts may be varied while maintaining the above-mentioned functionalities and constructive types. In particular, RFID or optical identification and detection systems, radio transmission systems, if present, and the different types of magnetic sensors used may be changed. Furthermore, the arrangement of the magnetic sensors (101) arranged in grid form on the sensorized board (100) may be changed: for example, a regular square grid, but characterized by a different pitch, or rectangular or differently shaped grids, may be used to fit modular tiles (200) whose base surface element (201) differs from the square shape illustrated in the example embodiment, such as tiles consisting of hexagonal or triangular base elements.

The invention claimed is:

1. A system for identifying and tracking gaming elements provided with a magnetic marker and a unique identification code, comprising:

a remote electronic device;

a plurality of gaming elements configured to be positioned on an interactive modular game board progressively assembled by a player;

a sensorized board equipped with a set of magnetic sensors being arranged according to a fixed pitch grid;

a plurality of modular tiles positionable by the player on the sensorized board so as to construct a game scenario, wherein each modular tile of the plurality of modular tiles includes at least one base surface element of dimensions equal to a pitch of the fixed pitch grid of the set of magnetic sensors, wherein each modular tile of the plurality of modular tiles is provided with decorations corresponding to the game scenario, and wherein the gaming elements are positioned on one or more modular tiles;

a series of lines indicated on the modular tiles, the series of lines configured to delimit portions of the modular tiles corresponding to interactive areas of the game scenario;

a plurality of graphic interaction elements configured to identify the interactive areas of the game scenario, the graphic interaction elements being positioned at a centre of a base surface element;

a series of profiled elements configured to superimpose the modular tiles on the sensorized board and align the graphic interaction elements with the magnetic sensor grid; and a control unit connected to the sensorized board, the control unit configured to acquire a magnetic sensor status vector of data relating to the magnetic Q-sensors and transmit to, the remote electronic device, a masked result vector of data relating to a subset of said magnetic sensors to be used to track the gaming elements, wherein the data of the magnetic sensor status vector corresponding to the subset of magnetic sensors underlying the graphic interaction elements of the modular tiles used is selected by: multiplying the corresponding components of the magnetic sensor status vector by a mask vector indicating the magnetic sensors underlying the graphic interaction elements of the tiles, and filtering according to the masked result vector, and wherein the gaming elements are identified and tracked based on the masked result vector.

2. The system for identifying and tracking according to claim 1, wherein components Fi of the mask vector are acquired according to the tiles positioned by the player on the sensorized board according to the following formulas:

(1) F.i=1 for the magnetic sensors underlying the graphic interaction elements of the tiles; and (2) F.i=0 for remaining magnetic sensors.

3. The system for identifying and tracking according to claim 1, wherein the control unit comprises:

an interface connected to the set of magnetic sensors;

an identification apparatus configured to acquire unique identification codes;

a central processing unit (CPU);

a memory; and a wireless or wired communication interface.

4. The system for identifying and tracking according to claim 1, wherein each modular tile further includes an identification code.

5. The system for identifying and tracking according to claim 3, wherein the identification apparatus comprises a radio-frequency identification (RFID) reader equipped with a single antenna.

6. The system for identifying and tracking according to claim 3, wherein the identification apparatus is an optical identification apparatus.

7. The system for identifying and tracking according to claim 1, wherein the profiled elements comprise a shape used for anchoring to the sensorized board and further comprises a raised edge, wherein the raised edge is configured to be used as a side edge for the modular tiles.

8. The system for identifying and tracking according to claim 1, wherein the sensorized board is foldable.

9. A method, comprising:

providing the system for identifying and tracking according to claim 1;

determining the vector using the system for identifying and tracking gaming elements; by:

identifying the modular tiles and the position thereof on the sensorized board;

identifying the subset of magnetic sensors underlying the graphic interaction elements of the modular tiles as identified;

determining the mask vector corresponding to the subset of magnetic sensors as identified;

acquiring the magnetic sensor status vector of the status of the set of magnetic sensors; and determining the masked result vector by multiplying the corresponding components of the magnetic sensor status vector by a mask vector.

10. The method according to claim 9, further comprising:

detecting the unique identification code of each new gaming element positioned on the sensorized board;

identifying an initial position of the new gaming element as identified by analysing variations in the masked result vector following the positioning of the gaming element on a graphic interaction element;

storing the unique identification data and a current position for each gaming element;

defining a sequential order of turns, in which each gaming element interacts with the gaming surface created by the tiles positioned on the sensorized board;

detecting, at each turn of play, changes in the masked result vector and determining the interactive areas of the game scenario in which the gaming element is used, the gaming element positioned on the graphic interaction element corresponding to the portion; and defining a mode of interaction or movement of the gaming element in turn with the portion of the gaming surface based on predefined rules associated with the game.

11. The system of claim 1, wherein the plurality of modular tiles are non-uniformly shaped, and wherein the corresponding base surface elements of each of the plurality of modular tiles are uniformly shaped.

12. The system of claim 1, wherein the control unit identifies a gaming event associated with the gaming element on the sensorized board based on predefined rules in accordance with the game scenario.

* * * * *